US011002108B2

(12) United States Patent
Sehsah et al.

(10) Patent No.: US 11,002,108 B2
(45) Date of Patent: May 11, 2021

(54) SYSTEMS AND METHODS FOR SMART MULTI-FUNCTION HOLE CLEANING SUB

(71) Applicant: Saudi Arabian Oil Company, Dhahran (SA)

(72) Inventors: Ossama R. Sehsah, Dhahran (SA); Mahmoud Adnan Alqurashi, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 226 days.

(21) Appl. No.: 15/884,661

(22) Filed: Feb. 26, 2018

(65) Prior Publication Data

US 2019/0264539 A1 Aug. 29, 2019

(51) Int. Cl.

| | |
|---|---|
| ***E21B 47/06*** | (2012.01) |
| ***E21B 21/10*** | (2006.01) |
| ***E21B 37/00*** | (2006.01) |
| ***E21B 34/14*** | (2006.01) |
| ***E21B 41/00*** | (2006.01) |
| *E21B 21/00* | (2006.01) |

(52) U.S. Cl.

CPC ..... *E21B 34/14* (2013.01); *E21B 21/103* (2013.01); *E21B 41/0078* (2013.01); *E21B 47/06* (2013.01); *E21B 21/003* (2013.01); *E21B 37/00* (2013.01); *E21B 2200/06* (2020.05)

(58) Field of Classification Search

CPC ..... E21B 2034/007; E21B 34/14; E21B 41/0078; E21B 21/103

See application file for complete search history.

(56) References Cited

U.S. PATENT DOCUMENTS

| | | | | |
|---|---|---|---|---|
| 4,373,582 A * | 2/1983 | Bednar | ..... | E21B 21/103 166/321 |
| 4,760,735 A | 8/1988 | Sheppard et al. | | |
| 5,150,757 A | 9/1992 | Nunley | | |
| 5,564,500 A | 10/1996 | Rogers et al. | | |
| 5,861,362 A | 1/1999 | Mayeux et al. | | |
| 6,357,536 B1 | 3/2002 | Schrader et al. | | |

(Continued)

FOREIGN PATENT DOCUMENTS

WO 2017077345 A1 5/2017

OTHER PUBLICATIONS

The International Search Report and Written Opinion for related PCT application PCT/US2019/019495 dated May 9, 2019.

*Primary Examiner* — Robert E Fuller
(74) *Attorney, Agent, or Firm* — Bracewell LLP; Constance G. Rhebergen; Linda L. Morgan

(57) ABSTRACT

Systems and methods for drilling optimization of a subterranean well include securing a multifunction sub in line with a tubular string. A nozzle provides a fluid flow path from the central bore through a sidewall of the sub body, the nozzle oriented in a direction so that the fluid flow path directs a wellbore fluid from within the central bore in a direction uphole. A valve system can move between a closed position where the fluid flow path of the nozzle is closed, and at least one open position where the wellbore fluid can pass through the fluid flow path. A control system is operable to receive information and provide a signal to move the valve system. The tubular string is moved into a bore of the subterranean well and information is delivered to the control system to regulate the flow of wellbore fluid through the nozzle.

20 Claims, 2 Drawing Sheets

(56) References Cited

U.S. PATENT DOCUMENTS

| | | | | |
|---|---|---|---|---|
| 7,541,412 | B2 | 6/2009 | Sita | |
| 2006/0225881 | A1* | 10/2006 | O'Shaughnessy | E21B 47/01 166/250.17 |
| 2012/0160520 | A1 | 6/2012 | Lumbye | |
| 2013/0008648 | A1* | 1/2013 | Lovorn | E21B 47/06 166/250.01 |
| 2013/0306318 | A1 | 11/2013 | Frosell et al. | |
| 2014/0332277 | A1* | 11/2014 | Churchill | E21B 21/103 175/57 |
| 2015/0053483 | A1 | 2/2015 | Mebane, III | |
| 2016/0201412 | A1 | 7/2016 | Midlang et al. | |
| 2016/0258249 | A1 | 9/2016 | Symms | |
| 2017/0335629 | A1 | 11/2017 | Radford et al. | |

* cited by examiner

SYSTEMS AND METHODS FOR SMART MULTI-FUNCTION HOLE CLEANING SUB

BACKGROUND OF THE DISCLOSURE

1. Field of the Disclosure

The disclosure relates generally to hydrocarbon development operations in a subterranean well, and more particularly to smart tools for use in a subterranean well during drilling operations.

2. Description of the Related Art

During operations in a subterranean well, such as drilling operations, there are times when the operations are stopped to allow for separate tools to be introduced to perform certain corrective procedures with the bore of the subterranean well. Such corrective procedures can cause delays and increase the costs of the subterranean operation.

SUMMARY OF THE DISCLOSURE

Systems and methods of this disclosure provide a multifunction sub or tool that can be part of a tubular string, such as a drilling string, during operations in a subterranean well, such as during drilling operations. The multifunction sub can perform a number of corrective procedures and improve the performance of subterranean operations by cleaning cuttings and other debris from within the bore of the subterranean well, reducing fluid losses from thief zones, enabling the injection of treatment fluids, such as fluids that include treatment pills to free a stuck pipe, and can enable the circulation of kill fluids into the subterranean well in case of emergency. The multifunction tool can also provide for reverse circulation operations, such as for negative testing. The multifunction sub can be programmed to act automatically when certain bore characteristics are encountered, and can be remotely operated with a programmable logic controller. The multifunction sub can in these ways, as well as others, increase wellbore integrity and reduce risks associated with subterranean well operations, such as drilling operations.

In an embodiment of this disclosure a method for improving subterranean operations within a subterranean well includes securing a multifunction sub in line with a tubular string. The multifunction sub has a sub body, the sub body being an elongated member with a central bore. A nozzle provides a fluid flow path from the central bore through a sidewall of the sub body, the nozzle oriented in a direction offset from a central axis of the sub body so that the fluid flow path is operable to direct a wellbore fluid from within the central bore in a direction uphole. A valve system is operable to move between a closed position where the fluid flow path of the nozzle is closed, and at least one open position where the wellbore fluid can pass through the fluid flow path. The multifunction sub further includes a control system, the control system operable to receive information and provide a signal to move the valve system. The tubular string is moved into a bore of the subterranean well and the information is delivered to the control system to regulate a flow of wellbore fluid through the nozzle.

In alternate embodiments, the multifunction sub can further include a pressure sensor operable to deliver the information to the control system. The valve system can include a sliding sleeve that is moveable by a hydraulic pressure unit. The method can further include regulating the flow of wellbore fluid through the nozzle to generate a turbulent flow around the tubular string. The flow of wellbore fluid through the nozzle can be regulated by moving the valve system to one of the at least one open positions. A buildup of cuttings can be removed from the bore with the turbulent flow.

In other alternate embodiments, the wellbore fluid can include a lost circulation material and the method can further include positioning the multifunction sub at an elevation of a thief zone of the subterranean well, moving the valve system to one of the at least one open positions, and delivering the wellbore fluid through the nozzle to the thief zone. Alternately, the wellbore fluid can include a kill fluid and the method can further include moving the valve system to one of the at least one open positions, and delivering the wellbore fluid through the nozzle to the bore. The wellbore fluid can include a treatment fluid and the method can further include moving the valve system to one of the at least one open positions and delivering the wellbore fluid through the nozzle to the bore. The method can further include moving the valve system to one of the at least one open positions and reverse circulating the wellbore fluid through the nozzle. Alternately, the method can further include securing a logging while drilling tool in line with the tubular string, where the logging while drilling tool is operable to deliver the information to the control system.

In an alternate embodiment of this disclosure, a system for improving subterranean operations within a subterranean well includes a multifunction sub in line with a tubular string. The multifunction sub has a sub body, the sub body being an elongated member with a central bore. The system can further include a nozzle with a fluid flow path from the central bore through a sidewall of the sub body. The nozzle is oriented in a direction offset from a central axis of the sub body so that the fluid flow path is operable to direct a wellbore fluid from within the central bore in a direction uphole. A valve system has a closed position where the fluid flow path of the nozzle is closed, and at least one open position where the wellbore fluid can pass through the fluid flow path. The system can further include a control system, the control system operable to receive information and provide a signal to move the valve system. The tubular string is located in a bore of the subterranean well and the control system is operable to regulate a flow of wellbore fluid through the nozzle.

In alternate embodiments, the multifunction sub can further include a pressure sensor operable to deliver the information to the control system. The valve system can include a sliding sleeve that is moveable by a hydraulic pressure unit. The nozzle can be operable to regulate the flow of wellbore fluid through the nozzle to generate a turbulent flow around the tubular string when the valve system is in one of the at least one open positions.

In other alternate embodiments, the wellbore fluid can include a lost circulation material and the multifunction sub can be located at an elevation of a thief zone of the subterranean well with the valve system in one of the at least one open positions so that the multifunction sub is operable to deliver the wellbore fluid through the nozzle to the thief zone. Alternately, the wellbore fluid can include a kill fluid and the valve system can be in one of the at least one open positions, and operable to deliver the wellbore fluid through the nozzle to the bore. The wellbore fluid can alternately include a treatment fluid and the valve system can be in one of the at least one open positions and operable to deliver the wellbore fluid through the nozzle to the bore. A logging while drilling tool can be located in line with the tubular string, where the logging while drilling tool is operable to deliver the information to the control system.

BRIEF DESCRIPTION OF THE DRAWINGS

So that the manner in which the previously-recited features, aspects and advantages of the embodiments of this disclosure, as well as others that will become apparent, are attained and can be understood in detail, a more particular description of the disclosure briefly summarized previously may be had by reference to the embodiments that are illustrated in the drawings that form a part of this specification. It is to be noted, however, that the appended drawings illustrate only certain embodiments of the disclosure and are, therefore, not to be considered limiting of the disclosure's scope, for the disclosure may admit to other equally effective embodiments.

DETAILED DESCRIPTION OF THE DISCLOSURE

The disclosure refers to particular features, including process or method steps. Those of skill in the art understand that the disclosure is not limited to or by the description of embodiments given in the specification. The subject matter of this disclosure is not restricted except only in the spirit of the specification and appended Claims.

Those of skill in the art also understand that the terminology used for describing particular embodiments does not limit the scope or breadth of the embodiments of the disclosure. In interpreting the specification and appended Claims, all terms should be interpreted in the broadest possible manner consistent with the context of each term. All technical and scientific terms used in the specification and appended Claims have the same meaning as commonly understood by one of ordinary skill in the art to which this disclosure belongs unless defined otherwise.

As used in the Specification and appended Claims, the singular forms "a", "an", and "the" include plural references unless the context clearly indicates otherwise.

As used, the words "comprise," "has," "includes", and all other grammatical variations are each intended to have an open, non-limiting meaning that does not exclude additional elements, components or steps. Embodiments of the present disclosure may suitably "comprise", "consist" or "consist essentially of" the limiting features disclosed, and may be practiced in the absence of a limiting feature not disclosed. For example, it can be recognized by those skilled in the art that certain steps can be combined into a single step.

Where a range of values is provided in the Specification or in the appended Claims, it is understood that the interval encompasses each intervening value between the upper limit and the lower limit as well as the upper limit and the lower limit. The disclosure encompasses and bounds smaller ranges of the interval subject to any specific exclusion provided.

Where reference is made in the specification and appended Claims to a method comprising two or more defined steps, the defined steps can be carried out in any order or simultaneously except where the context excludes that possibility.

Figure 1:
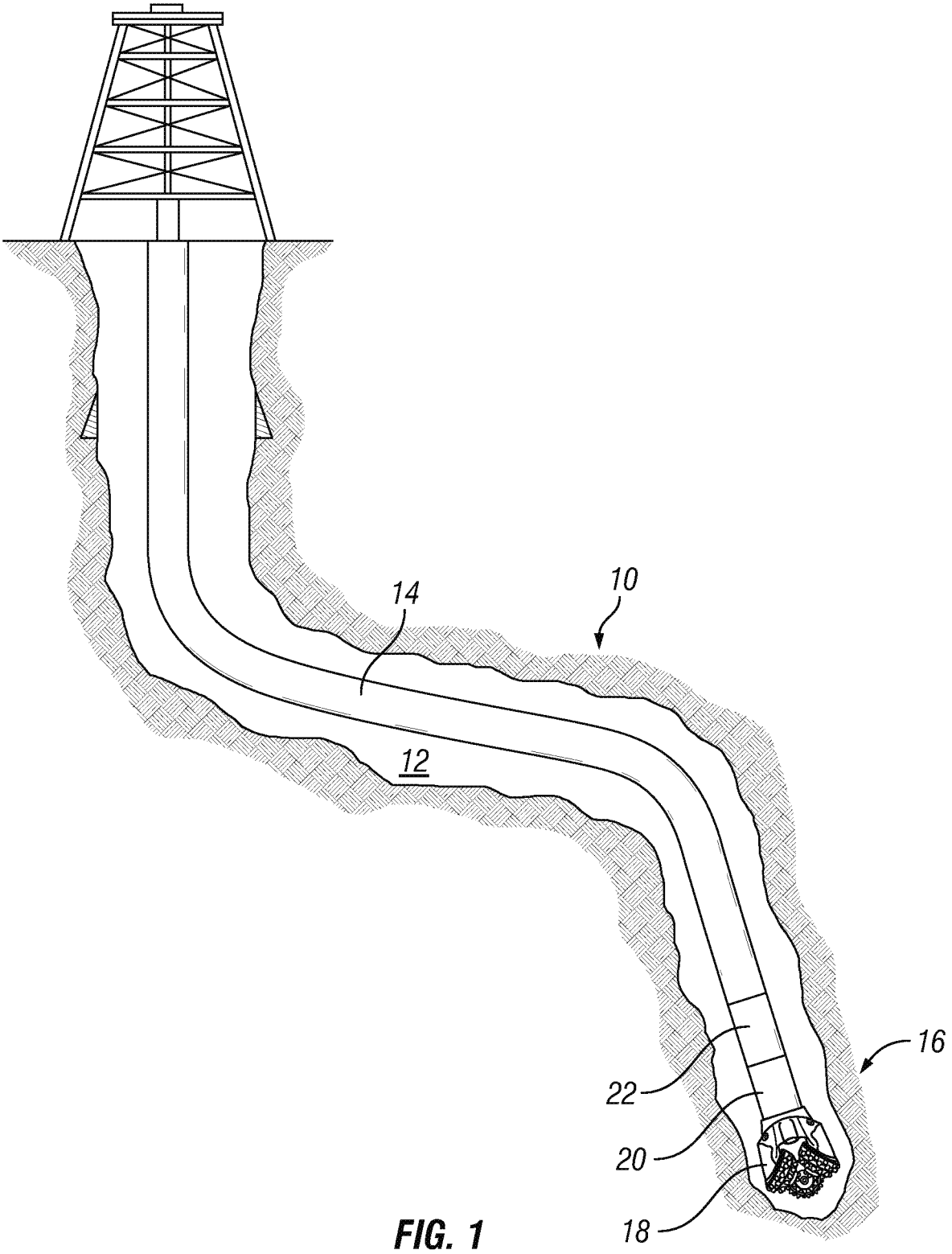
FIG. 1 is a schematic sectional representation of a subterranean well having a multifunction sub, in accordance with an embodiment of this disclosure.

Looking at FIG. 1, subterranean well 10 extends downwards from a surface of the earth, which can be a ground level surface or a subsea surface. Bore 12 of subterranean well 10 can extended generally vertically relative to the surface. Bore 12 can alternately include portions that extend generally horizontally or in other directions that deviate from generally vertically from the surface. Subterranean well 10 can be a well associated with hydrocarbon development operations, such as a hydrocarbon production well, an injection well, or a water well.

Tubular string 14 extends into bore 12 of subterranean well 10. Tubular string 14 can be, for example, a drill string, a casing string, or another elongated member lowered into subterranean well 10. Although bore 12 is shown as an uncased opening, in embodiments where tubular string 14 is an inner tubular member, bore 12 can be part of an outer tubular member, such as casing.

Tubular string 14 can include downhole tools and equipment that are secured in line with joints of tubular string 14. Tubular string 14 can have, for example, a bottom hole assembly 16 that can include a drilling bit 18 and logging while drilling tools 20. Drilling bit 18 can rotate to create bore 12 of subterranean well 10. Logging while drilling tools 20 can be used to measure properties of the formation adjacent to subterranean well 10 as bore 12 is being drilled. Logging while drilling tools 20 can also include measurement while drilling tools that can gather data regarding conditions of and within bore 12, such as the azimuth and inclination of bore 12.

Figure 2:
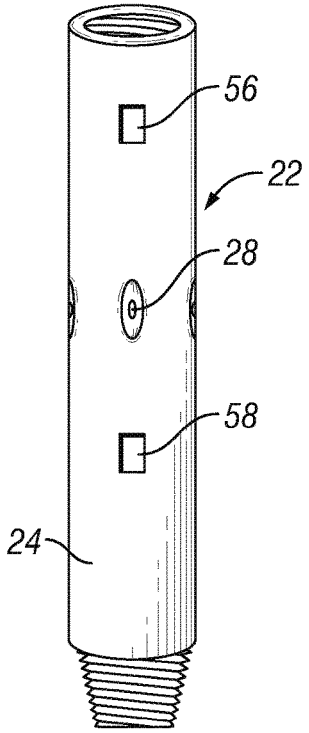
FIG. 2 is a schematic perspective view of a multifunction sub, in accordance with an embodiment of this disclosure.

Multifunction sub 22 can also be secured in line with tubular string 14. Looking at FIGS. 2-4, multifunction sub 22 can have sub body 24. Sub body 24 can be an elongated member with central bore 26. Sub body 24 can be formed, as an example, of the same material as tubular string 14 or components of bottom hole assembly 16. Tubular string 14 can have an upper connection 27*a* and lower connection 27*b* for securing multifunction sub 22 in line with tubular string 14. As an example, upper connection 27*a* and lower connection 27*b* can be threaded connections.

More than one multifunction sub 22 can be used within a single tubular string 14. Each multifunction sub 22 can be programmed based on the placement of such multifunction sub 22 within tubular string 14. Multiple multifunction subs 22 can work independently or together, as needed to achieve the desired results improvement to subterranean operations in bore 12. The number and location of multifunction subs 22 used in tubular string 14 can be determined through simulation techniques, which can balance any reductions in drilling efficiency with the projected drilling improvements provided by the multifunction sub 22.

Multifunction sub 22 can also include nozzle 28 that extends from central bore 26 through a sidewall of sub body 24. Nozzle 28 provides a fluid flow path so that wellbore fluids can travel between central bore 26 of sub body 24 and bore 12 of subterranean well 10. During certain operations, wellbore fluids will travel from within central bore 26 of sub body 24, through nozzle 28, and to bore 12. During certain other operations, wellbore fluids can travel from bore 12, through nozzle 28 and into central bore 26 of sub body 24.

Multifunction sub 22 can have a single nozzle 28 or a number of nozzles 28 spaced around a circumference of sub body 24. As an example, there can be three or four nozzles 28 spaced equally around multifunction sub 22. In alternate embodiments, there can be more than four or less than three nozzles 28, depending on the size of tubular string 14. Nozzle 28 can be oriented in a direction offset from central axis 30 of sub body 24 so that the fluid flow path is operable to direct the wellbore fluid from within central bore 26 in a direction uphole. Looking at FIG. 3, the fluid flow path of nozzle 28 can have a flow path axis 32 that is at angle 34 relative to central axis 30 of sub body 24. Angle 34 is greater than zero degrees and less than ninety degrees. In alternate embodiments, angle 34 is in a range of 30 to 50 degrees and in an alternate embodiment can be 45 degrees to direct the flow in an upward direction. The selection of the number and location of nozzles 28 as well as the shape and orientation of nozzle 28 will be dependent on the projected shear stress, viscosity, pump rate, superficial velocity, annular velocity, and solid suspension of wellbore fluid.

Figure 3:
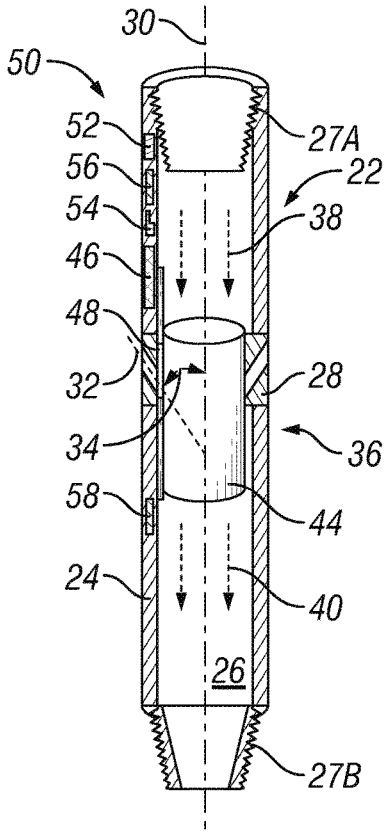
FIG. 3, is a section view of multifunction sub, in accordance with an embodiment of this disclosure, shown with a valve system in a closed position.
Figure 4:
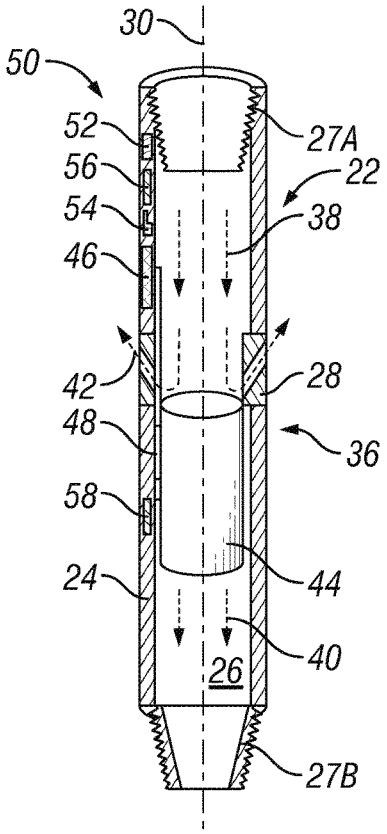
FIG. 4, is a section view the multifunction sub shown with the valve system in one of the open positions.

Looking at FIGS. 3-4, multifunction sub 22 can further include valve system 36. Valve system 36 has a closed position (FIG. 3) where the fluid flow path of nozzle 28 is closed, and at least one open position (FIG. 4) where wellbore fluid can pass through the fluid flow path of nozzle 28. Looking at FIG. 3, when valve system 36 is in the closed position, no fluid can pass through nozzle 28 between central bore 26 of sub body 24 and bore 12 of subterranean well 10. Therefore when valve system 36 is in the closed position all of the wellbore fluid entering a first end of multifunction sub 22, which is shown in FIG. 3 as entering fluid 38, exits at a second end of multifunction sub 22, which is shown in FIG. 3 as exiting fluid 40. No portion of the wellbore fluid exits multifunction sub 22 by way of nozzle 28.

Looking at FIG. 4, when valve system 36 is in one of the open positions, a portion of the entering fluid 38 can exit central bore 26 of multifunction sub 22 by passing through nozzle 28, which is shown in FIG. 4 as nozzle fluid 42. Another portion of the wellbore fluid can exit at the second end of multifunction sub 22 as exiting fluid 40. The relative amounts of entering fluid 38 that exits multifunction sub 22 through nozzle 28 compared to the amount of entering fluid 38 that exits through second end of multifunction sub 22 is determined by the position of valve system 36. Valve system 36 can have a number of open positions that range from a fully open position to a position that is nearly closed. As an example, valve system 36 can have four to eight separate open positions for moderating the amount of entering fluid 38 that can exit multifunction sub 22 through nozzle 28. In alternate embodiments, valve system 36 can have fewer than four open positions or more than eight open positions.

Looking at FIGS. 3-4, valve system 36 can include sliding sleeve 44 that is moveable by way of a hydraulic pressure unit 46. Sliding sleeve 44 can move axially within sub body 24. When valve system 36 is in the closed position of FIG. 3, sliding sleeve 44 blocks nozzle 28 so that no wellbore fluid can pass through nozzle 28. When valve system 36 is in an open position, sliding sleeve 44 does not block at least a part of nozzle 28, leaving that part of nozzle 28 open so that a portion of the wellbore fluid can pass through nozzle 28.

Hydraulic pressure unit 46 can, for example, manage the operation of a pressurized fluid that can be used to move piston member 48 associated with sliding sleeve 44 in either an uphole or downhole direction to move valve system 36 between the closed position and an open position, or to move valve system 36 between different open positions. Sliding sleeve can be biased by a spring (not shown) that biases valve system 36 to a closed position.

Multifunction sub 22 can include control system 50 for receiving information and using such information to provide a signal for moving valve system 36 to regulate the amount of wellbore fluid that passes through nozzle 28. Control system 50 can include energy source 52 for providing power required to operate control system 50 and optionally, energy source 52 can provide power required to operate other features and functions multifunction sub 22. Energy source 52 can be, for example, a battery, a fluid driven assembly, or a connection mechanism for receiving power from a surface source.

Control system 50 can further include programmable logic controller 54. Programmable logic controller 54 be strategically programmed based on the well profile, expected mud weight, and configuration of the bottom hole assembly to deliver the expected function required. Programmable logic controller 54 can control valve system 36 automatically based on the pre-programmed information provided to programmable logic controller 54. Automatic operation of control system 50 is particularly useful for hole cleaning purposes.

Alternately, programmable logic controller 54 can receive instructions or information from the surface or other source regarding the control of valve system 36. As an example, multifunction sub 22 can include one or more pressure sensor for detecting a pressure within bore 12 and providing information to programmable logic controller 54.

Looking at FIGS. 3-4, multifunction sub 22 can include uphole pressure sensor 56 and downhole pressure sensor 58. Each of uphole pressure sensor 56 and downhole pressure sensor 58 can deliver pressure information to programmable logic controller 54. Uphole pressure sensor 56 and downhole pressure sensor 58 can detect a pressure within bore 12, within central bore 26 of sub body 24, or within both bore 12 and within central bore 26. Programmable logic controller 54 can move valve system 36 to regulate the amount of wellbore fluid that passes through nozzle 28 based on absolute pressure values received from uphole pressure sensor 56 and downhole pressure sensor 58, or based on a difference between pressure values received from uphole pressure sensor 56 and downhole pressure sensor 58.

As an example, uphole pressure sensor 56 and downhole pressure sensor 58 can be used to detect if an equivalent circulating density in bore 12 has increased. The equivalent circulating density is the effective mud weight at a given depth that is a result of the total hydrostatic and dynamic well pressures. An increase in the equivalent circulating density can indicate an accumulation of cuttings or caving of the formation surrounding bore 12.

Alternately, uphole pressure sensor 56 or downhole pressure sensor 58 can be used to detect a pressure differential between bore 12 and central bore 26 of sub body 24. Programmable logic controller 54 can receive the differential pressure information and based on pre-programmed pressure differential instructions, programmable logic controller 54 can move valve system 36 to improve drilling performance. The expected range for the pressure differential will depend on the well profile and pre job hydraulic analysis. Programmable logic controller can be programmed for a specific range of pressure differential for each application or use of multifunction sub 22. For example, an increased pressure differential can indicate geo-mechanical instability and the valve system can be moved to a maximum one of the open positions for maximizing cleaning of bore 12 with turbulent flow generated by wellbore fluids exiting nozzle 28. If the differential pressure reaches a level that is above the ability of multifunction sub 22 to correct, then programmable logic controller 54 can provide such information to an operator, who can use such information to determine a health of bore 12 and can adjust features of the mud being used in bore 12, such as increase a weight of the mud, to stabilize bore 12. Caving and formation collapse issues can be related to the weight of the mud used in bore 12 and corrective action can be taken by an operator to change the weight of the mud to reduce and stop such caving so that drilling operations can continue.

Alternately logging while drilling tools 20 can deliver information to programmable logic controller 54 of control system 50 so that programmable logic controller 54 can control valve system 36.

In an example of operation, multifunction sub 22 can be secured in line with tubular string 14 uphole of other bottom hole assembly 16 components and tubular string 14 can be moved into subterranean well 10. Once located in subterranean well 10, multifunction sub 22 can be used for multiple different functions. As an example, multifunction sub 22 can be used for bore or hole cleaning operations, lost circulation, well kick control or well killing, unsticking a stuck pipe, reverse circulation, and other known wellbore tool operations.

When used for hole cleaning operations, control system 50 can be used to move valve system 36 to at least one of the open positions. The flow of wellbore fluid through nozzle 28 can generate a turbulent flow around tubular string 14. The turbulent flow around tubular sting 14 can remove a buildup of cuttings from bore 12. The turbulent flow can disturb the cuttings so that the cuttings are forced away from the wellbore wall. Eventually, the cuttings can be swept out of bore 12. In alternate embodiments, the turbulent flow can remove other obstructions within bore 12.

The fluid flow exiting nozzle 28 can include both axial and radial flow. The axial flow component can assist in reducing solid suspension and stratification of the wellbore fluid that can lead to obstructions in bore 12. The radial component of the fluid flow exiting nozzle 28 can provide higher shear rates. The sheer rates are important to help agitate the cuttings and lift them upward out of the wellbore to increase hole cleaning efficiency. The amount of axial flow compared to the amount of radial flow is a function of angle 34 of fluid flow path of nozzle relative to central axis 30 of sub body 24. Turbulent flow is required to push the flow and cuttings more efficient.

For horizontal sections of bore 12, such as those sections with ninety degree inclinations, cuttings will tend to gather on the low side of the bore 12 and the flow of wellbore fluid will pass above the cuttings can make cleaning difficult. It can be challenging and expensive, and can require extensive amount of sweeps to attempt to remove the cuttings from bore 12 with currently available technology. Hole cleaning operations of multifunction sub 22 may also be particularly useful in angled sections of bore 12 with thirty to sixty-five degree inclinations.

When used for lost circulation, wellbore fluid includes a lost circulation material and multifunction sub 22 can be positioned within subterranean well 10 at an elevation of a thief zone of subterranean well 10. A thief zone is known as a formation adjacent to bore 12 into which circulating fluids are lost. Control system 50 can be used to move valve system 36 to at least one of the open positions so that the wellbore fluid can be delivered through nozzle 28 to the thief zone. After the lost circulation has been corrected, control system 50 can move valve system 36 to the closed position so that no fluid can pass through nozzle 28 and all of the wellbore fluid entering a first end of multifunction sub 22 as entering fluid 38 exits at the second end of multifunction sub 22 as exiting fluid 40.

When used for well kick control or well killing, control system 50 can be used to move valve system 36 to at least one of the open positions and wellbore fluid can be delivered through nozzle 28 to bore 12. In certain embodiments, the wellbore fluid can contain a kill fluid. The use of kill fluid may be required, for example, in situations where mud flow nozzles in drilling bit 18 are plugged. In alternate embodiments, when trying to control subterranean well, such as after a pressure spike within subterranean well 10, the heavier mud or drilling fluid can be delivered entirely through drilling bit 18 by moving valve system 36 to the closed position with control system 50.

When used for stuck pipe situations, control system 50 can be used to move valve system 36 to at least one of the open positions and wellbore fluid can be delivered through nozzle 28 to bore 12. In such an embodiment, the wellbore fluid can include a treatment fluid. In other such embodiments where the stuck pipe is due to a pressure differential, the wellbore fluid can have a density that is greater than the mud within bore 12 so that the pipe can be unstuck.

When used for reverse circulation, control system 50 can be used to move valve system 36 to at least one of the open positions so that wellbore fluid can be circulated into central bore 26 of sub body 24 from bore 12 of subterranean well 10. Such reverse circulation operations can be used, for example, for negative testing or inflow testing operations. In alternate embodiments, the reverse circulation operation can be a cleaning operation and the wellbore fluid can include a treatment such as an acid or grease pill, or can include a push pill for acting as a piston or creating an interface between the mud and the casing sweep.

Embodiments of this disclosure can therefore provide systems and methods for providing multiple functions with a single tool to improve subterranean well operations, such as drilling operations. Multifunction sub 22 can be a smart tool that provides for automated operations.

Embodiments of the disclosure described, therefore, are well adapted to carry out the objects and attain the ends and advantages mentioned, as well as others that are inherent. While example embodiments of the disclosure have been given for purposes of disclosure, numerous changes exist in the details of procedures for accomplishing the desired results. These and other similar modifications will readily suggest themselves to those skilled in the art, and are intended to be encompassed within the spirit of the present disclosure and the scope of the appended claims.

What is claimed is:

1. A method for drilling optimization of a subterranean well, the method including:

securing a multifunction sub in line with a tubular string, the multifunction sub having:

a sub body, the sub body being an elongated member with a central bore;

a nozzle providing a fluid flow path from the central bore through a sidewall of the sub body, the nozzle oriented in a direction offset from a central axis of the sub body at an angle in a range of 30 to 50 degrees so that the fluid flow path is operable to direct a wellbore fluid from within the central bore in a direction uphole;

a valve system operable to move between a closed position where the fluid flow path of the nozzle is closed, and at least one open position where the wellbore fluid can pass through the fluid flow path;

an uphole pressure sensor and a downhole pressure sensor located downhole of the uphole pressure sensor, at least one of the uphole pressure sensor and the downhole pressure sensor positioned to measure a pressure differential between a bore of the subterranean well and the central bore of the sub body; and a control system, the control system operable to receive pressure information from the uphole pressure sensor and the downhole pressure sensor and to provide a signal to move the valve system, the pressure information comprising the pressure differential;

moving the tubular string into the bore of the subterranean well;

measuring an uphole pressure with the uphole pressure sensor and measuring a downhole pressure with the downhole pressure sensor to generate the pressure information;

delivering the pressure information to a programmable logic controller of the control system; and moving the valve system in response to the pressure information delivered to the programmable logic controller to regulate a flow of wellbore fluid through the nozzle.

2. The method of claim 1, where the pressure information delivered to the programmable logic controller of the control system includes an equivalent circulating density.

3. The method of claim 1, where the valve system includes a sliding sleeve that is moveable by a hydraulic pressure unit.

4. The method of claim 1, further including regulating the flow of wellbore fluid through the nozzle to generate a turbulent flow around the tubular string.

5. The method of claim 4, further including regulating the flow of wellbore fluid through the nozzle by moving the valve system to one of the at least one open positions.

6. The method of claim 4, further including removing a buildup of cuttings from the bore with the turbulent flow.

7. The method of claim 1, where the wellbore fluid includes a lost circulation material and the method further includes positioning the multifunction sub at an elevation of a thief zone of the subterranean well, moving the valve system to one of the at least one open positions, and delivering the wellbore fluid through the nozzle to the thief zone.

8. The method of claim 1, where the wellbore fluid includes a kill fluid and the method further includes moving the valve system to one of the at least one open positions, and delivering the wellbore fluid through the nozzle to the bore.

9. The method of claim 1, where the wellbore fluid includes a treatment fluid and the method further includes moving the valve system to one of the at least one open positions and delivering the wellbore fluid through the nozzle to the bore.

10. The method of claim 1, further including moving the valve system to one of the at least one open positions and reverse circulating the wellbore fluid through the nozzle.

11. The method of claim 1, further including securing a logging while drilling tool in line with the tubular string, where the logging while drilling tool is operable to deliver the information to the control system.

12. A system for drilling optimization of a subterranean well, the system including:

a multifunction sub in line with a tubular string, the multifunction sub having:

a sub body, the sub body being an elongated member with a central bore;

a nozzle with a fluid flow path from the central bore through a sidewall of the sub body, the nozzle oriented in a direction offset from a central axis of the sub body at an angle in a range of 30 to 50 degrees so that the fluid flow path is operable to direct a wellbore fluid from within the central bore in a direction uphole;

a valve system having a closed position where the fluid flow path of the nozzle is closed, and at least one open position where the wellbore fluid can pass through the fluid flow path;

an uphole pressure sensor and a downhole pressure sensor located downhole of the uphole pressure sensor, where at least one of the uphole pressure sensor and the downhole pressure sensor is positioned to measure a pressure differential between a bore of the subterranean well and the central bore of the sub body; and a control system having a programmable logic controller, the control system operable to receive pressure information from the uphole pressure sensor and the downhole pressure sensor and to provide a signal to move the valve system, the pressure information comprising the pressure differential; where the tubular string is located in a bore of the subterranean well; and the control system is operable to regulate a flow of wellbore fluid through the nozzle by moving the valve system in response to the pressure information delivered to the programmable logic controller.

13. The system of claim 12, where the pressure information delivered to the programmable logic controller of the control system includes an equivalent circulating density.

14. The system of claim 12, where the valve system includes a sliding sleeve that is moveable by a hydraulic pressure unit.

15. The system of claim 12, where the nozzle is operable to regulate the flow of wellbore fluid through the nozzle to generate a turbulent flow around the tubular string when the valve system is in one of the at least one open positions.

16. The system of claim 12, where the wellbore fluid includes a lost circulation material and the multifunction sub is located at an elevation of a thief zone of the subterranean well with the valve system in one of the at least one open positions so that the multifunction sub is operable to deliver the wellbore fluid through the nozzle to the thief zone.

17. The system of claim 12, where the wellbore fluid includes a kill fluid and the valve system is in one of the at least one open positions, and operable to deliver the wellbore fluid through the nozzle to the bore.

18. The system of claim 12, where the wellbore fluid includes a treatment fluid and the valve system is in one of the at least one open positions and operable to deliver the wellbore fluid through the nozzle to the bore.

19. The system of claim 12, further including a logging while drilling tool located in line with the tubular string, where the logging while drilling tool is operable to deliver the information to the control system.

20. A method for drilling optimization of a subterranean well, the method including:

securing a multifunction sub in line with a tubular string, the multifunction sub having:

a sub body, the sub body being an elongated member with a central bore;

a nozzle providing a fluid flow path from the central bore through a sidewall of the sub body, the nozzle oriented in a direction offset from a central axis of the sub body so that the fluid flow path is operable to direct a wellbore fluid from within the central bore in a direction uphole;

a valve system operable to move between a closed position where the fluid flow path of the nozzle is closed, and more than one open position where the wellbore fluid can pass through the fluid flow path;

an uphole pressure sensor and a downhole pressure sensor located downhole of the uphole pressure sensor, where at least one of the uphole pressure sensor and the downhole pressure sensor is positioned to measure a pressure differential between a bore of the subterranean well and the central bore of the sub body; and a control system, the control system operable to receive pressure information from the uphole pressure sensor and the downhole pressure sensor and to provide a signal to move the valve system, the pressure information comprising the pressure differential;

moving the tubular string into a bore of the subterranean well;

measuring an uphole pressure with the uphole pressure sensor and measuring a downhole pressure with the downhole pressure sensor to generate the pressure information; and delivering the pressure information to the control system to regulate a flow of wellbore fluid through the nozzle.

* * * * *